US009305691B2

(12) United States Patent
Takahashi et al.

(10) Patent No.: US 9,305,691 B2
(45) Date of Patent: Apr. 5, 2016

(54) SUPERCONDUCTING MAGNET APPARATUS

(71) Applicant: KABUSHIKI KAISHA TOSHIBA, Minato-Ku (JP)

(72) Inventors: Masahiko Takahashi, Yokosuka (JP); Taizo Tosaka, Yokohama (JP); Hiroshi Miyazaki, Yokohama (JP); Sadanori Iwai, Kawasaki (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 374 days.

(21) Appl. No.: 14/315,736

(22) Filed: Jun. 26, 2014

(65) Prior Publication Data

US 2015/0051079 A1 Feb. 19, 2015

(30) Foreign Application Priority Data

Jun. 28, 2013 (JP) ..... 2013-137459

(51) Int. Cl.
*H01F 6/00* (2006.01)
*H01F 6/04* (2006.01)
*H01F 6/06* (2006.01)

(52) U.S. Cl.
CPC ... *H01F 6/04* (2013.01); *H01F 6/06* (2013.01)

(58) Field of Classification Search
CPC ..... H01F 6/00; H01F 6/04; H01F 6/06
See application file for complete search history.

(56) References Cited

U.S. PATENT DOCUMENTS

2005/0198974 A1* 9/2005 Roth ..... F25B 9/145 62/51.1
2007/0102422 A1* 5/2007 Thomas ..... H01F 6/003 219/666
2015/0007586 A1* 1/2015 Kraus ..... G01R 33/3815 62/51.1
2015/0024941 A1* 1/2015 Tamura ..... H01F 6/00 505/211

* cited by examiner

*Primary Examiner* — Daniel Rohrhoff
(74) *Attorney, Agent, or Firm* — Oblon, McClelland, Maier & Neustadt, L.L.P.

(57) ABSTRACT

According to one embodiment, a superconducting magnet apparatus includes: a first superconducting coil and a second superconducting coil respectively arranged in a vacuum container; a first cooling unit configured to cool the first superconducting coil; and a second cooling unit configured to cool the second superconducting coil and controlled independently from the first cooling unit by a cooling method different from the cooling method of the first cooling unit.

11 Claims, 2 Drawing Sheets

SUPERCONDUCTING MAGNET APPARATUS

CROSS-REFERENCE TO RELATED APPLICATIONS

This application is based upon and claims the benefit of priority from Japanese Patient application No. 2013-137459, filed on Jun. 28, 2013, the entire contents of each of which are incorporated herein by reference.

BACKGROUND OF THE INVENTION

1. Field of the Invention

The present invention relates to a superconducting magnet apparatus configured to generate a high magnetic field.

2. Description of the Related Art

When a superconducting coil is cooled to an ultra-low temperature, the electrical resistance of the superconducting coil becomes zero. By using this characteristic, the superconducting coil can increase current density without generating joule heat, and hence the superconducting coil is suitable for generating a high magnetic field. A superconducting magnet apparatus configured by using the superconducting coil having such characteristic is widely used as a high magnetic field generator in the field of research of physical properties, and the like.

Here, the superconducting coil needs to be cooled to an ultra-low temperature of about 4 K, and hence liquid helium, or the like, is used as a refrigerant.

The liquid helium is difficult to be directly handled and is not an abundant resource, and hence in recent years, the method has been widely used, in which the superconducting coil is cooled by using an ultra-low temperature refrigerator.

With the spread of the ultra-low temperature refrigerator, the practical use of, in particular, a high temperature superconductor has been rapidly advanced.

For example, a high magnetic field generator using a small refrigerator has been developed by combining a high-temperature superconducting coil with a low-temperature superconducting coil (see, for example, TEION KOUGAKU (J. Cryo. Soc. Jpn.), Vol. 41, No. 7, P 322-327).

In the superconducting magnet apparatus described above, it is sufficient, in the steady state, only to cool the amount of heat of about 1 to 2 W generated due to heat penetration and heat generation at a connecting portion, but the amount of heat, which is several times the amount of heat generated in the steady state, is generated in excitation or demagnetization due to magnetic hysteresis loss caused by magnetic field change.

Therefore, in order to further promote the practical use of the superconducting magnet apparatus, a refrigerator having a large refrigerating capacity is required to cope with the heat generation in excitation or demagnetization.

In the low temperature superconducting coil, the magnetic hysteresis loss is reduced by developing a low-loss conductor such as a multifilamentary wire, but the magnetic hysteresis loss is large in the high temperature superconducting coil.

On the other hand, the size of the high temperature superconducting coil is required to be increased in order to obtain high magnetic field, and hence there is a problem that the refrigerating capacity of a refrigerator must be significantly increased.

SUMMARY OF THE INVENTION

The present invention has been made in view of the above-described circumstances. An object of the present invention is to provide a superconducting magnet apparatus in which cooling can be efficiently performed to cope with large heat generation.

DETAILED DESCRIPTION OF THE PREFERRED EMBODIMENTS

First Embodiment

In the following, an embodiment of the present invention will be described with reference to an accompanying drawing.

Figure 1:
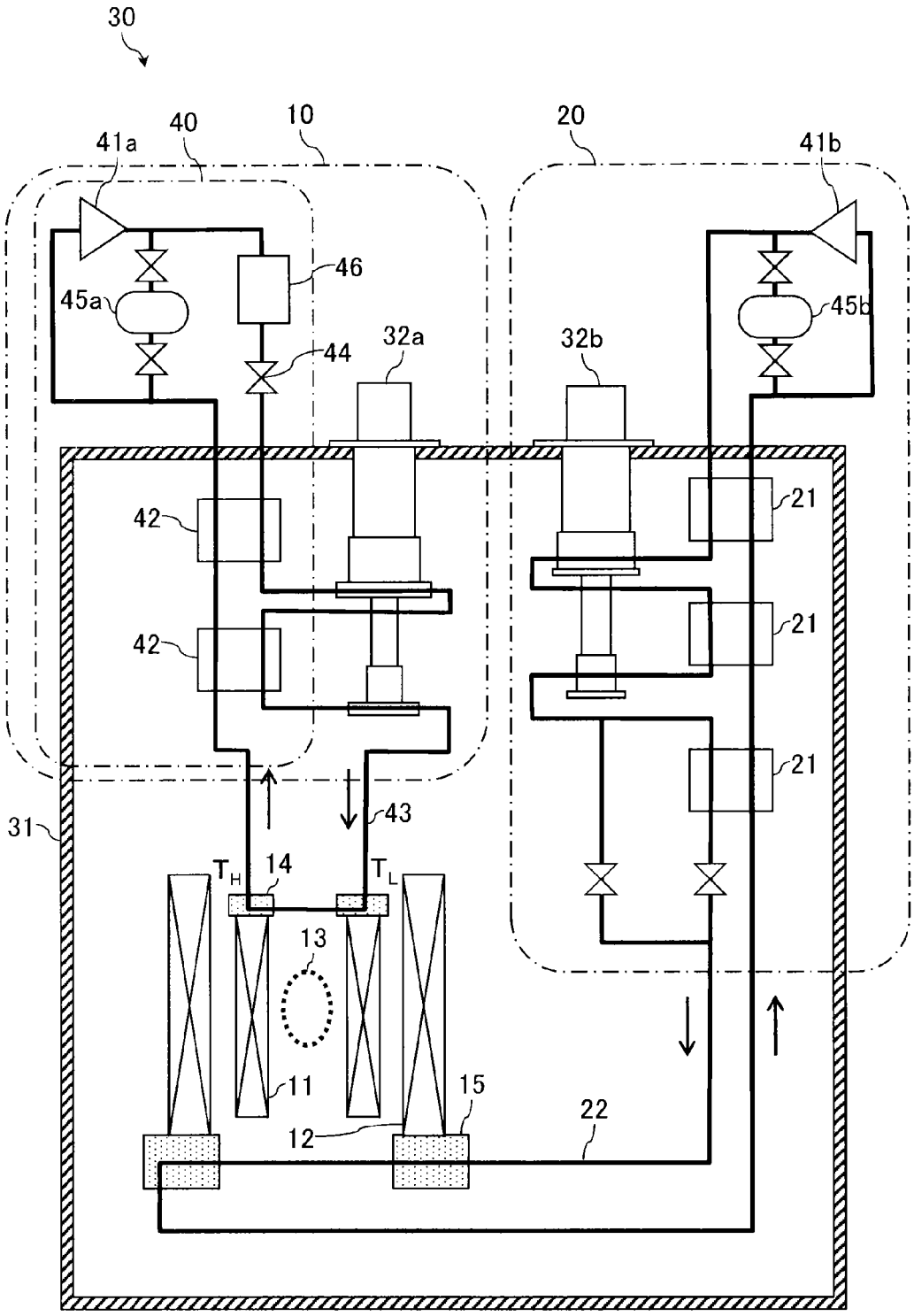
FIG. 1 is a block diagram showing a first embodiment of a superconducting magnet apparatus according to the present invention.

As shown in FIG. 1, a superconducting magnet apparatus 30 according to a first embodiment includes a first superconducting coil 11 arranged in a vacuum container 31, a second superconducting coil 12 arranged coaxially with the first superconducting coil 11, a first cooling unit 10 cooling the first superconducting coil 11, and a second cooling unit 20 controlled independently from the first cooling unit 10 and cooling the second superconducting coil 12.

In each of the embodiments, the first superconducting coil 11 is a high temperature superconducting coil 11.

A first cooling stage 14 is connected to one side end surface of the high temperature superconducting coil 11, and the first cooling stage 14 heat-exchanges with the first cooling unit 10.

In each of the embodiments, the second superconducting coil 12 is a low temperature superconducting coil 12.

A second cooling stage 15 is connected to one side end surface of the low temperature superconducting coil 12, and the second cooling stage 15 heat-exchanges with the second cooling unit 20.

In this way, the cylindrical first superconducting coil 11 and the cylindrical second superconducting coil 12 are arranged coaxially with each other, and thereby the magnetic field generated by the first superconducting coil 11, and the magnetic field generated by the second superconducting coil 12 are superimposed with each other, so that a high strength magnetic field is generated in a magnetic field space 13.

Further, the first superconducting coil 11 and the second superconducting coil 12 are supported in the vacuum container 31 so as not to be brought into contact with each other, and hence the temperature of each of the first superconducting coil 11 and the second superconducting coil 12 is independently controlled by each of the first cooling unit 10 and the second cooling unit 20.

It should be noted that, in each of the embodiments, the high temperature superconducting coil is arranged on the inner side, and the low temperature superconducting coil is arranged on the outer side. However, the embodiments also includes a case where this arrangement relationship is reversed, a case where the first superconducting coil 11 and the second superconducting coil 12 are both the high temperature superconducting coils, and a case where the first superconducting coil 11 and the second superconducting coil 12 are both the low temperature superconducting coils.

Here, in a narrow sense, the high temperature superconducting coil is a coil which has a superconductivity critical temperature not less than about 25 K, and which is made of a superconducting material, such as $YBa_2Cu_3O_7$, $Bi_2Sr_2Ca_2Cu_3O_{10}$, and $MgB_2$. The low temperature superconducting coil is a coil which has a superconductivity critical temperature not more than about 25 K, and which is made of a superconducting material, such as NbTi and $Nb_3Sn$.

Further, in a broad sense, the high temperature superconducting coil is a coil having a superconductivity critical temperature higher than the superconductivity critical temperature of the low temperature superconducting coil.

Further, the two superconducting coils are arranged in each of the embodiments, and one cooling unit corresponds to each of the two superconducting coils. However, there is also a case where three or more superconducting coils are arranged, and there is also a case where one cooling unit is arranged for cooling two or more superconducting coils.

Further, there is exemplified a case where the cylindrical first superconducting coil 11 and the cylindrical second superconducting coil 12 are arranged coaxially with each other, but there is also a case where each of a pair of four coils or six coils are arranged, as required, so as to face each other and on a horizontal plane.

The first cooling unit 10 is configured by combining a Gifford-McMahon refrigerator (GM refrigerator) 32*a* with a gas circulation heat transfer circuit 40.

The low temperature gas, which is cooled by the Gifford-McMahon refrigerator 32*a*, is sent to the cooling stage 14 to be heat-exchanged, and is then circulated through the gas circulation heat transfer circuit 40, so as to be sent to heat exchangers 42.

The gas circulation heat transfer circuit 40 is configured by a gas circulation compressor 41*a*, the heat exchangers 42 arranged in two stages, and a first pipe 43 connecting these to the first cooling stage 14.

Further, a flow regulation valve 44, a buffer tank 45*a*, and a flow meter 46 are attached to the gas circulation heat transfer circuit 40.

The amount of heat Q transferred by the gas circulation heat transfer circuit 40 is determined, as shown in following expression (1), by the temperature difference between the inlet temperature $T_L$ and the outlet temperature $T_H$ of the cooling stage 14, and the gas flow rate m.

$$Q=mC(T_H-T_L) \quad (1)$$

In a case where the heat transfer rate Q is determined, when the gas flow rate m is small, the inlet-outlet temperature difference $(T_H-T_L)$ of the cooling stage 14 is increased, and hence the outlet temperature $T_H$ is increased, as a result of which the temperature of the first superconducting coil 11 is increased.

On the other hand, when the gas flow rate m is too large, the amount of heat entering the GM refrigerator 32*a* is increased due to the loss of the heat exchanger 42, and hence the temperature of the GM refrigerator 32*a* is increased, as a result of which the temperature of the first superconducting coil 11 is increased.

Therefore, the gas flow rate of the gas circulation heat transfer circuit 40 is controlled to be always optimum in order to maintain the cooling performance of the first superconducting coil 11.

The optimum gas flow rate changes depending on the coil temperature.

For this reason, when the coil temperature is largely changed, such as when the first superconducting coil 11 is pre-cooled from room temperature to ultra-low temperature, the gas flow rate m is controlled according to the coil temperature.

The coil temperature is measured by a thermometer (not shown), and the flow regulation valve 44 is adjusted according to the measured temperature.

It should be noted that, in each of the embodiments, it is assumed that a high intensity magnetic field is generated in the magnetic field space 13. The GM refrigerator 32*a* may cause a problem in operation by receiving the influence of magnetic field, and hence it is desired that the GM refrigerator 32*a* is sufficiently separated from the superconducting coils 11 and 12.

For this reason, the gas circulation heat transfer circuit 40 is configured such that the length of the pipe 43 held at low temperature is long, and such that the volume in the pipe held at the low temperature is also large.

Here, when the gas temperature is made low, the gas pressure in the pipe is made low, and in an extreme case, a safety device of the gas circulation compressor 41*a* is operated.

To cope with this, the buffer tank 45*a* having a sufficient capacity is provided in the room temperature atmosphere, and thereby the excessive decrease of the gas pressure in the pipe 43 can be suppressed.

It should be noted that, in each of the embodiments, the first cooling unit 10 is exemplified with a configuration in which the GM refrigerator 32*a* and the gas circulation heat transfer circuit 40 are assembled with each other. However, in a case where the distance between the GM refrigerator 32*a* and each of the superconducting coils 11 and 12 can be reduced, the first cooling unit 10 can also be configured by combining the GM refrigerator 32*a* and a metal heat transfer plate (not shown) instead of the gas circulation heat transfer circuit 40.

Further, it is also considered to adopt a cold accumulation refrigerator, such as a pulse tube refrigerator and a Stirling refrigerator, instead of the GM refrigerator 32*a*.

A GM/JT refrigerator configured by assembling a GM refrigerator 32*b* and a Joule-Thompson refrigerator 21 is adopted as the second cooling unit 20.

The second cooling unit 20 is controlled independently from the first cooling unit 10, and is configured such that the refrigerant cooled to low temperature by the GM/JT refrigerator is sent to the second cooling stage 15 so as to be heat-exchanged, and is again sent to the second cooling unit 20.

In the GM/JT refrigerator in which the GM refrigerator 32*b* is used for pre-cooling, the exhaust gas pressure on the side of the JT refrigerator 21 is lowered to atmospheric pressure of about 0.1 MPa, and thereby helium as refrigerant is liquefied.

In general, the GM/JT refrigerator is excellent in the refrigeration efficiency at a temperature level of 4 K as compared with the GM refrigerator, but in a temperature region higher than 4 K, the GM/JT refrigerator is inferior in the refrigeration efficiency as compared with the GM refrigerator.

It should be noted that, in the GM/JT refrigerator of the second cooling unit 20, it is considered to adopt a cold accumulation refrigerator, such as a pulse tube refrigerator and a Stirling refrigerator, instead of the GM refrigerator 32*b*.

The GM refrigerator 32*b* may cause a problem in operation by receiving the influence of magnetic field, and hence it is desired that the GM refrigerator 32*b* is sufficiently separated from the superconducting coils 11 and 12.

For this reason, the circuit of the second cooling unit 20 is configured such that the length of a second pipe 22 held at low temperature is long, and such that the volume in the pipe held at the low temperature is also large.

Here, when the gas temperature is made low, the gas pressure in the pipe is made low, and in an extreme case, a safety device of a gas circulation compressor 41*b* is operated.

To cope with this, a buffer tank 45*b* having a sufficient capacity is provided in the room temperature atmosphere, and thereby the excessive decrease of the gas pressure in the pipe 22 can be suppressed.

In the first embodiment configured as described above, when large heat (for example, about 10 W) is generated from the high temperature superconducting coil 11 in excitation, the temperature of the GM refrigerator 32*a* is increased, and the coil temperature is also increased.

Here, in the GM refrigerator 32*a*, when the cooling temperature is increased, the refrigeration capacity is rapidly increased. Therefore, even when a thermal load of 10 W is applied to the refrigerator of 1 W at the temperature of 4 K, the temperature may be balanced at about 10 K.

The high temperature superconducting coil can sufficiently maintain the superconductivity even at the temperature of about 10 K, and hence the function of the high magnetic field generator is not deteriorated.

On the other hand, in the GM/JT refrigerator, when the thermal load exceeds the refrigeration capacity at the temperature of 4 K, the temperature balance is lost, so that the temperature is rapidly increased. Therefore, three refrigerators are required in order to obtain the refrigeration capacity of 10 W at the temperature of 4 K.

On the other hand, in the low temperature superconducting coil cooled by the GM/JT refrigerator, the generation of heat due to the magnetic hysteresis loss according to magnetic field change in excitation or demagnetization is small.

Further, the GM/JT refrigerator is arranged independently from the high temperature superconducting coil. Therefore, the amount of heat penetration due to the temperature rise of the high temperature superconducting coil is sufficiently small, and hence the risk of being exposed to thermal load exceeding the refrigeration capacity is small.

In this way, with the configuration of the present embodiment, even when a large amount of heat is generated in the high temperature superconducting coil in excitation or demagnetization, the coil can be maintained the cooling to a predetermined temperature or less without greatly increasing the number of refrigerators.

Second Embodiment

Figure 2:
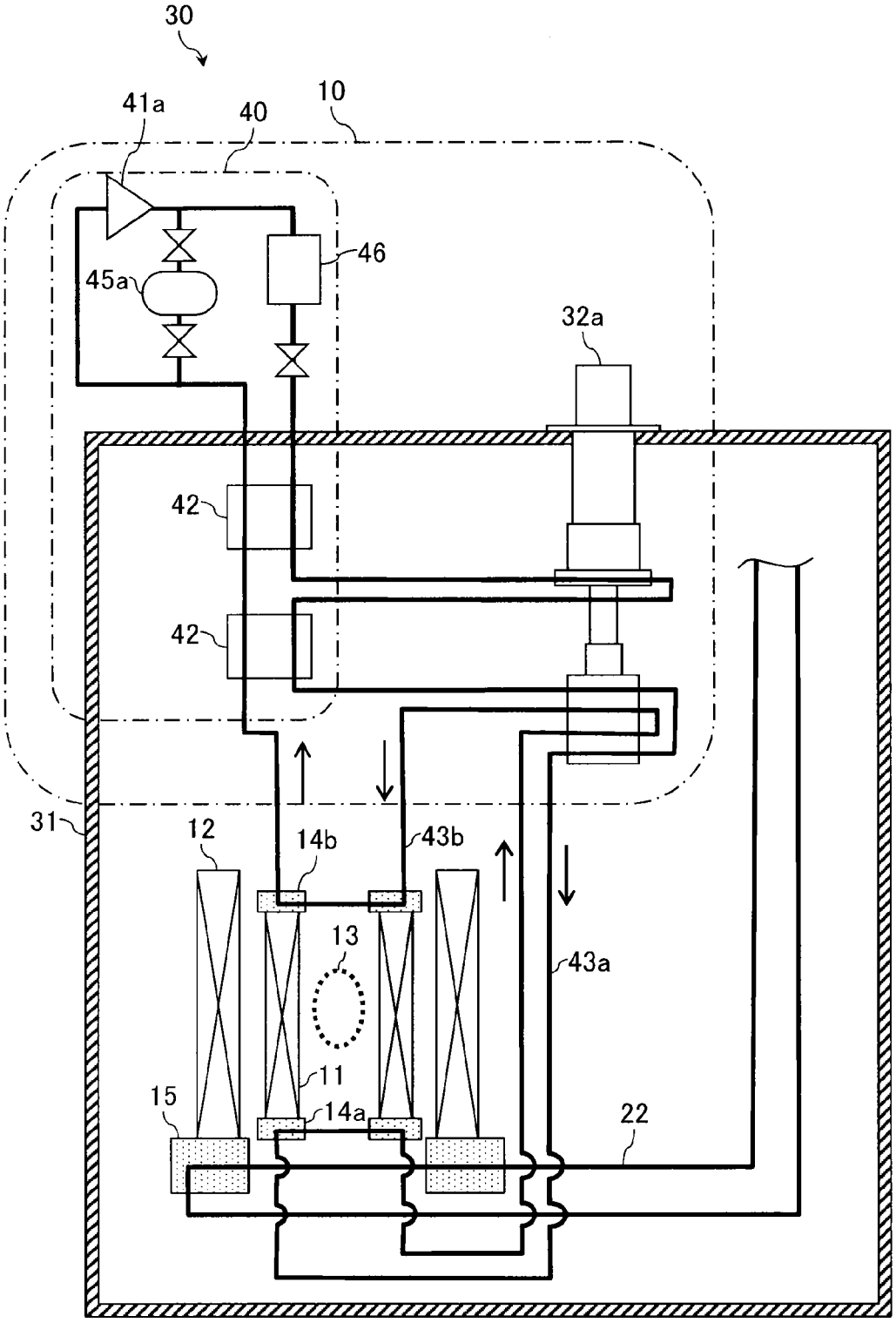
FIG. 2 is a block diagram showing a second embodiment of a superconducting magnet apparatus according to the present invention.

Next, a second embodiment according to the present invention will be described with reference to FIG. 2. The portions in FIG. 2 which have configurations or functions common to those in FIG. 1 are denoted by the same reference numerals and characters, and the description thereof is omitted. It should be noted that, in FIG. 2, the description of the second cooling unit 20 is omitted.

In the second embodiment, the high temperature superconducting coil (first superconducting coil 11) is cooled in such a manner that cooling stages 14*a* and 14*b* are respectively provided at both ends of the high temperature superconducting coil.

Each of pipes 43*a* and 43*b*, which are extended from the gas circulation heat transfer circuit 40 so as to be able to perform heat exchange, is made to penetrate through each of the cooling stages 14*a* and 14*b*.

Further, the pipes 43*a* and 43*b* are arranged to reciprocate a plurality of times between the superconducting coil 11 to be cooled and the GM refrigerator 32*a* in such a manner that the refrigerant passing through the cooling stages 14*a* and 14*b* is made to pass through the GM refrigerator 32*a* immediately before passing through the cooling stages 14*a* and 14*b*.

In the second embodiment, the cooling stages 14*a* and 14*b* are respectively provided at both ends of the coil, and thereby the heat transfer amount of each of the stages is made equal to each other, so that the inlet-outlet temperature difference of each of the stages is reduced to one half of the inlet-outlet temperature difference in the case of the first embodiment.

It is known that the magnetic hysteresis loss of the high temperature superconducting coil is concentrated on the both end portions of the coil. In the second embodiment, the places, at which most heat is generated, are cooled in a concentrated manner, and hence the temperature distribution can also be reduced, so that efficient cooling is realized.

Further, in the second embodiment, the pipe 43*a* (43*b*) is reciprocated only once through the one cooling stage 14*a* (14*b*), but it is also considered to arrange the pipe so that the pipe reciprocates a plurality of times through the cooling stage 14*a* (14*b*).

With the superconducting magnet apparatus according to at least one of the above-described embodiments, a plurality of superconducting coils arranged in a vacuum container are cooled by at least two cooling units which are independently controlled. Thereby, it is possible to efficiently cool a large amount of generated heat.

It should be noted that, although some embodiments of the present invention have been described above, these embodiments are presented as examples, and are not intended to limit the scope of the invention. These embodiments can be implemented in other various forms, and various abbreviations, exchanges, changes and combinations can be made within a scope not deviating from the essence of the invention. These embodiments and their modifications are included in the scope and the essence of the invention, and are included in the invention described in the claims, and the equal scope thereof.

What is claimed is:

1. A superconducting magnet apparatus comprising:

a first superconducting coil and a second superconducting coil respectively arranged in a vacuum container;

a first cooling unit configured to cool the first superconducting coil; and a second cooling unit configured to cool the second superconducting coil and controlled independently from the first cooling unit by a cooling method different from the cooling method of the first cooling unit.

2. The superconducting magnet apparatus according to claim 1, wherein one of the first superconducting coil and the second superconducting coil is a high temperature superconducting coil, and the other of the first superconducting coil and the second superconducting coil is a low temperature superconducting coil.

3. The superconducting magnet apparatus according to claim 2, wherein the high temperature superconducting coil is cooled from both ends of the high temperature superconducting coil.

4. The superconducting magnet apparatus according to claim 1, wherein at least one of the first cooling unit and the second cooling unit is configured by combining a cold accumulation refrigerator with a Joule-Thompson refrigerator.

5. The superconducting magnet apparatus according to claim 4, wherein a buffer tank is provided at a circuit of the Joule-Thompson refrigerator.

6. The superconducting magnet apparatus according to claim 4, wherein the cold accumulation refrigerator is a Gifford-McMahon refrigerator.

7. The superconducting magnet apparatus according to claim 1, wherein at least one of the first cooling unit and the second cooling unit is a cold accumulation refrigerator.

8. The superconducting magnet apparatus according to claim 1, wherein at least one of the first cooling unit and the second cooling unit is configured by combining a cold accumulation refrigerator with a gas circulation heat transfer circuit.

9. The superconducting magnet apparatus according to claim 8, further comprising a measurement unit configured to measure a temperature of the first superconducting coil or the second superconducting coil, wherein the gas flow rate of the gas circulation heat transfer circuit is controlled on the basis of a temperature measurement value.

10. The superconducting magnet apparatus according to claim 8, wherein the gas circulation heat transfer circuit includes a buffer tank.

11. The superconducting magnet apparatus according to claim 8, wherein a pipe extending from the gas circulation heat transfer circuit is reciprocated a plurality of times between the cold accumulation refrigerator and the superconducting coil to be cooled.

* * * * *